United States Patent [19]

Palmer et al.

[11] Patent Number: 4,646,064

[45] Date of Patent: Feb. 24, 1987

[54] VOLUME CONTROL DEVICE FOR RINGER

[75] Inventors: Jerry D. Palmer; Robert J. Janus, both of Corinth; Larry D. Lambert, Burnsville, all of Miss.

[73] Assignee: ITT Corporation, New York, N.Y.

[21] Appl. No.: 681,167

[22] Filed: Dec. 13, 1984

[51] Int. Cl.[4] ..... G10K 1/36; G08B 3/00

[52] U.S. Cl. ..... 340/392; 116/149; 116/152; 340/384 R; 340/396; 340/402

[58] Field of Search ..... 340/384 R, 392, 396, 340/397, 401–403, 384 E; 116/148, 149, 152, 159; 179/182 R, 187, 108 R, 115 R, 110 A

[56] References Cited

U.S. PATENT DOCUMENTS

| | | | |
|---|---|---|---|
| 1,437,924 | 12/1922 | Todd | 116/149 |
| 2,590,500 | 3/1952 | Bredehoft et al. | 340/397 |
| 2,643,634 | 6/1953 | Hoyka | 340/402 |
| 2,692,380 | 10/1954 | Cleveland | 340/825.39 |
| 2,711,154 | 6/1955 | Graziani | 116/149 |
| 2,800,101 | 7/1957 | Amann et al. | 116/149 |
| 2,808,019 | 10/1957 | Houdek, Jr. | 116/149 |
| 3,487,811 | 1/1970 | Rothacker | 116/149 |
| 3,518,667 | 6/1970 | Hanna et al. | 340/396 |
| 3,609,761 | 9/1971 | Petrangelo | 340/396 |
| 4,054,870 | 10/1977 | Barber | 340/397 |
| 4,574,272 | 3/1986 | Brown | 340/384 R |

FOREIGN PATENT DOCUMENTS

| | | | |
|---|---|---|---|
| 2546640 | 4/1977 | Fed. Rep. of Germany | 116/149 |
| 2078425A | 1/1982 | United Kingdom | 116/152 |

*Primary Examiner*—James L. Rowland
*Assistant Examiner*—Brent A. Swarthout
*Attorney, Agent, or Firm*—John T. O'Halloran; Thomas F. Meagher

[57] ABSTRACT

A volume control device suitable for installation on the ringer of a telephone incorporates a tone control lever having a damping element cantilevered therefrom and extending as a wing from a point of pivoting in a direction generally parallel to a frame of the ringer. The lever further comprises an arm bent through the frame to serve as a handle, and a leg extending in an opposite direction from the pivot for contacting a detent structure integrally formed with the frame. Also, integrally formed with the frame, are a ramp and a guide. The guide extends upwardly from the frame and then over a path of travel of an outer end of the wing for urging the wing downward so as to ensure passage of the wing underneath a rim of the gong during a rotation of the lever about the pivot. The ramp is upstanding from the frame at an interior region of the gong, and faces the wing so as to allow the outer end of the wing to slide up on the ramp and thereby urge a substantially middle portion of the wing against a rim of the gong for absorbing sonic vibrations thereof. The foregoing construction provides for reduced complexity of assembly, effective damping of sonic vibrations, and economical manufacture.

15 Claims, 6 Drawing Figures

VOLUME CONTROL DEVICE FOR RINGER

BACKGROUND OF THE INVENTION

This invention relates to ringing devices for telephones and other applications and, more particularly, to a device for controlling the volume of sound emitted by a gong of a ringer.

A common form of bell or ringer used in telephones comprises a gong which emits sound upon vibration of the gong. An electromagnet operative in response to a telephone ring signal, drives a striker or clapper against the gong. A spring retracts the striker from the gong. Periodic motion of the striker during a striking of the gong induces the familiar sound of a telephone ring.

A feature commonly found on telephones is a volume control, or damper, which interacts with the striker and/or gong to reduce the intensity, or volume, of the sound. By way of example, one form of damper employs a mechanical constraint on the amplitude of the displacement of the striker. Another form of damper employs a spring which is pressed against a peripheral portion of the gong under control of a manually operated lever of the volume control. The same lever may also be used to operate the mechanical constraint on the striker displacement amplitude so that a telephone ringer can readily be constructed with either one or both of the foregoing exemplary devices for the control of the sound volume.

Further examples of telephone ringing devices are presented in the following U.S. Patents. U.S. Pat. No. 1,437,924 of Todd discloses a leather damping element which can be placed between a tapper and bell so as to reduce the intensity of sound.

U.S. Pat. No. 2,590,500 of Bredehoft et al discloses sound adjustment of a ringer by varying the spacing of gongs relative to a clapper. U.S. Pat. No. 2,643,634 discloses the deadening of sound by use of a wedge positioned on the end of a leg for insertion between a bell and a clapper. U.S. Pat. No. 2,692,380 of Cleaveland discloses an additional weight cantilevered on an armature which carries the bell clapper. U.S. Pat. No. 2,808,019 of Houdek,Jr. discloses a double armed damper for contacting gongs in a dual-gong ringer for reducing the volume of the sound. U.S. Pat. No. 4,054,870 discloses an eccentric mounting of a gong which mounting provides for a change of distance between a clapper and the gong to accomplish a volume control.

An important consideration in the process of manufacturing a ringer, such as a ringer for telephone use, is the amount of steps, particularly labor intensive steps, which need be taken in the fabrication of the ringer. In the foregoing art, a substantial number of parts are assembled to accomplish the function of sound volume control. This presents a problem in that the manufacturing process is not as economical as would be desired.

SUMMARY OF THE INVENTION

The foregoing problem is overcome and other advantages are provided by a volume control device for a ringer, particularly a telephone ringer, which employs a unitary lever assembly in accordance with the invention for reducing the sound volume. The lever assembly comprises a set of arms, one of which serves as a damping element. A second of the arms serves as a handle to permit manual pivoting of the lever assembly for urging the damping element in contact with the rim of a gong.

A third of the arms provides the function of a detent for holding the lever assembly in a desired position for a specific amount of attenuation of the sound volume.

With the exception of the arm serving as the damping element, other components of the lever assembly have the same physical arrangement as a corresponding tone control lever previously used in telephone ringers for operating a mechanical constraint on the amplitude of displacement of a clapper arm, and for pressing a spring against a gong to reduce the intensity of sound. Therefore, the configuration of the lever asembly is advantageous in providing the inventive volume control device for use in telephone equipment of conventional configuration.

The volume control device further comprises a guide for the damping element and a ramp which urges the element against the rim of the gong. The guide is operative during a pivoting of the lever assembly to guide an outer end of the damping element from a site away from the gong via a path between the gong and a frame of the ringer to the ramp. The ramp is located on the frame beneath the ringer so as to receive the end of the damping element during a hand-off from the guide. The pivoting motion of the lever assembly drives the damping element up the ramp to urge a portion of the damping element intermediate the outer end and a point of pivoting against the gong rim to attenuate sonic vibrations of the gong.

An important feature of the invention is found in the construction of the guide and the ramp. Both the guide and the ramp are formed integrally with the frame and, therefore, do not require the installation of separate components. Also, the detent requires no further components in that apertures or depression are formed within the frame for receipt of the third arm in performing the function of the detent.

BRIEF DESCRIPTION OF THE DRAWING

The foregoing aspects and other features of the invention are explained in the following description taken in connection with the accompanying drawing wherein.

DETAILED DESCRIPTION

Figure 1:
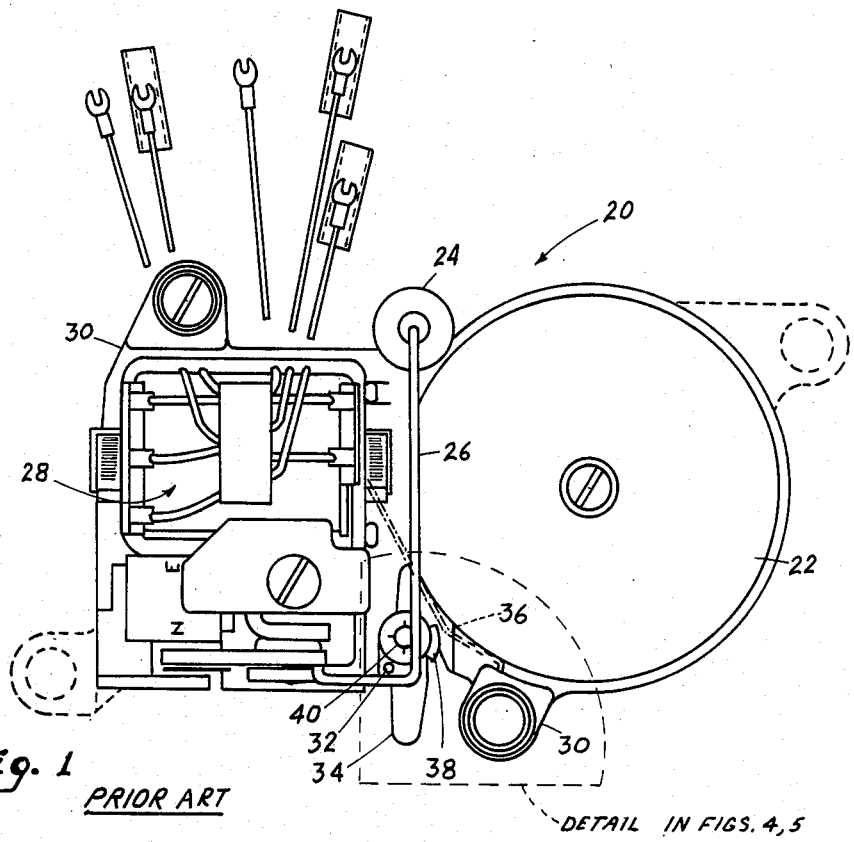
Fig. 1 PRIOR ART
FIG. 1 is a plan view of a conventional telephone ringer modified to incorporate a volume control device of the invention.
Figure 2:
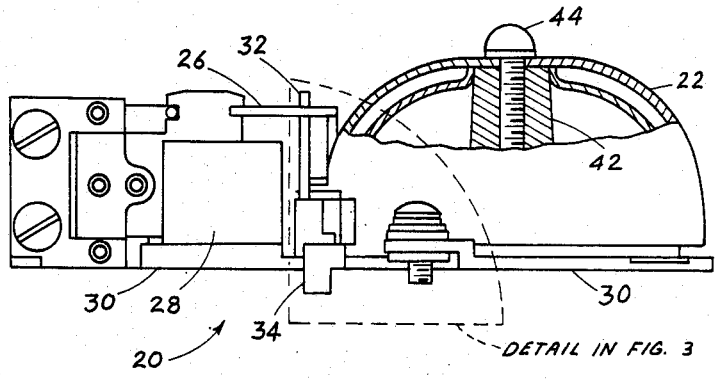
Fig. 2 PRIOR ART
FIG. 2 is a side view of the telephone ringer of FIG. 1.

FIGS. 1 and 2 show a standard form of telephone ringer 20 comprising a gong 22, a striker 24 mounted on the end of a rod 26 for inducing sonic vibrations in the gong 22, an electromagnet 28 for imparting oscillatory motion to the rod 26, and a frame 30 which supports the gong 22 and the electromagnet 28. Also shown in FIGS. 1 and 2 are two exemplary forms of tone damping for reducing the volume of sound emanating from the gong 22, one such form of damping being implemented by a stave 32 upstanding from a tone control lever 34 and passing alongside a path of motion of the rod 26 to decrease the amplitude of oscillatory displacement of the rod 26. A second form of implementation of damping is indicated in phantom by a spring 36 which is urged against the rim of the gong 22 by a tang 38 on the lever 34 for attenuating sonic vibrations in the gong 22. The amount of damping provided by either the stave 32 or the spring 36 can be varied by rotation of the lever 34 about a pivot shaft 40 which secures the lever 34 to the frame 30. The gong 22 is held in spaced-apart relation to the frame 30 by a post 42 to which the gong 22 is secured by a screw 44.

The ringer 20 responds to pulses of ring current applied to the electromagnet 28. The rod 26 with the striker 24 on the outboard end thereof is displaced in one direction during the presence of a pulse of ring current, and is displaced in the reverse direction by a spring during the intervals of time between successive ones of the ring pulses. The rod 26 may be fabricated of resilient metal so as to provide the function of the foregoing spring. The control lever 34 operates to implement a desired amount of damping by constraining either the amplitude of the oscillatory motion of the rod 26, by means of the stave 32, or the amplitude of oscillation of the gong 22, by the spring 36. Rotation of the lever 34 positions the stave 32 or the spring 36 to provide the desired reduction in the amplitude of oscillatory motion.

The encircled regions of FIGS. 1–2 show the portion of the ringer 20 relating to volume control, and which is to be replaced with the volume control device of the invention shown in FIGS. 3–6.

With reference also to FIGS. 3–6 which show the volume control device of the invention, adequate damping can be accomplished without use of the stave 32 or the spring 36. The invention provides for the use of a modified tone control lever 34A. The modification in the tone control lever is a wing 46 which extends from a central turret 48 transversely of an arm 50. The arm 50 is bent to form a handle which extends beyond the frame 30, the handle permitting a person to adjust the position of the tone control lever 34A. In the opposite direction of the arm 50, a leg 52 of the lever 34A extends from the turret 48. The tang 38 also extends from the turret 48, these components of the lever 34A being formed as a unitary structure which is readily manufactured by a molding operation. The lever 34A is secured to the shaft 40 by a nut 54 located at the top of the turret 48.

Figure 4:
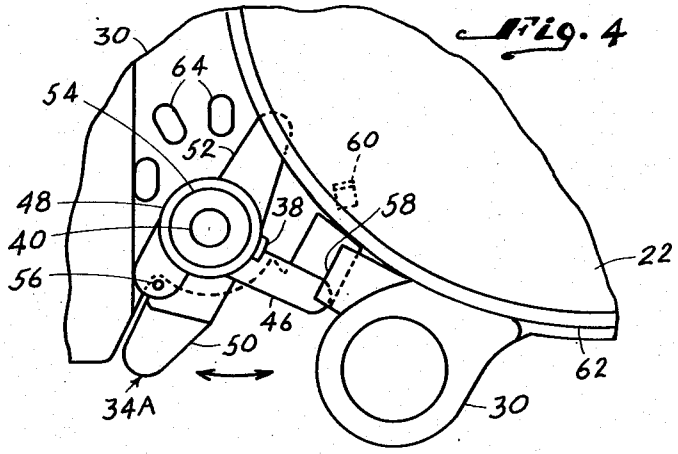
FIG. 4 is a corresponding plan view of the volume control device of FIG. 3, identified by a dashed circle in the view of the ringer in FIG. 1.
Figure 3:
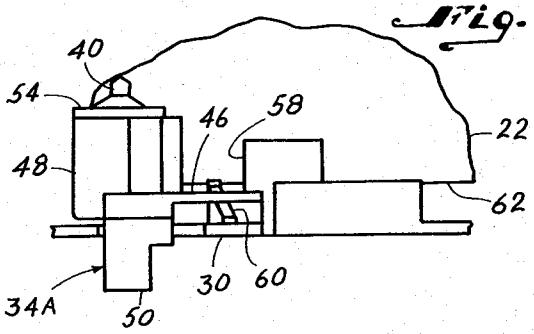
FIG. 3 is an enlarged side view of the volume control device identified by a dashed circle in the view of the ringer in FIG. 2, the control device being shown in the position of maximum volume.
Figure 5:
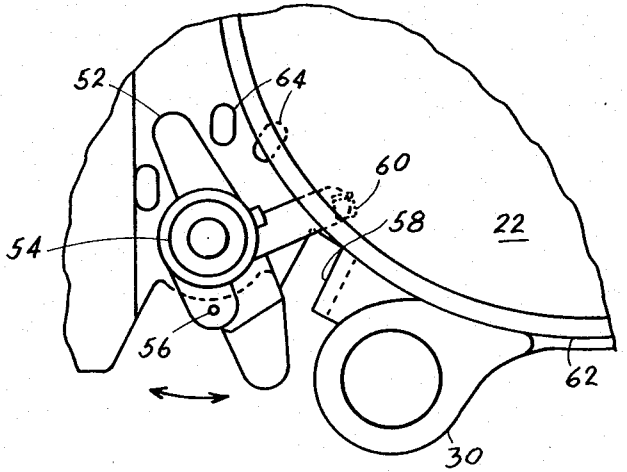
FIG. 5 is a further plan view of the volume control device of FIG. 3 wherein the volume control device is positioned for a reduction in sound volume.

To facilitate the viewing of the lever 34A in FIGS. 3–5, the striker rod 26 of FIGS. 1 and 2 has been deleted in FIGS. 3–5. Also, the stave 32 and the spring 36 of FIG. 1 have been deleted in FIGS. 3–5 to facilitate the showing of the lever 34A of the invention. An aperture 56 is shown in the lever 34A at the site of the stave 32, such aperture being used for mounting the stave 32 to the lever 34. The aperture 56 may be retained in the lever 34A if it is desired to maintain uniformity in the manufacture of the levers 34 and 34A.

The volume control apparatus of the invention further comprises a guide 58 and a ramp 60. The guide 58 is formed as an undercut in the frame 30 and extends over the top of the wing 46 so as to allow the wing 46 to pass beneath a rim 62 of the gong 22. Thereby, upon rotation of the lever 34A, the wing 46 swings past the guide 58 and enters into the space between the rim 62 and the frame 30 so as to pass onto the ramp 60.

The ramp 60 is integrally formed with and upstanding from the frame 30 at a location beneath the gong 22. As the lever 34A is rotated, the outer end of the wing 46 is forced to slide up the ramp 60. FIGS. 3–4 show the position of the wing 46 prior to an advancement thereof towards the ramp 60, while FIG. 5 shows the position of the wing 46 as the end of the wing 46 slides up the ramp 60. It is noted that the width of the wing 46 is sufficiently small to permit release of the wing 46 by the guide 58 prior to the elevation of the end of the wing 46 by the ramp 60.

The wing 46 serves as a damping element upon elevation of the end of the wing 46 by the ramp 60. As the wing 46 rides up the ramp 60 under rotation of the lever 34A, the region of the wing 46 between the outer end thereof and the turret 48 is pressed against the rim 62 of the gong 22. Such pressure increases with increasing elevation of the outer end of the wing 46 in response to increased rotation of the lever 34A. The entire assembly of the lever 34A, including the arm 50, the leg 52 and the wing 46 is stabilized and maintained in its vertical posture relative to the frame 30 by an envelopment of the shaft 40 by the turret 48. Thereby, during rotation of the lever 34A, the inboard end of the wing 46, at the turret 48, is retained with its horizontal attitude while the rest of the wing 46 is bent upwardly against the rim 62 by the force of the ramp 60 against the wing 46. The wing 46, as well as the rest of the lever 34A, may be fabricated of a relatively soft plastic material suitable for damping vibrations of the gong 22. The amount of damping is dependent on the amount of rotation of the lever 34A, and is thereby continuously adjustable over a range from zero attenuation to a maximum value of attenuation.

In order to secure the lever 34A in a position corresponding to a selected amount of sound attenuation, the frame 30 is provided with a set of depressions 64 which are formed as a part of the frame 30, and which are located along an arc positioned beneath a path of travel of the leg 52. The end portion of the leg 52 presses into the depressions 64 for holding the lever 34A in a desired position of rotation. Alternatively, the depressions 64 can be fabricated as elevations, and the leg 52 would be fabricated with a depression for receiving the elevations. In either case, the engagement of the leg 52 with the frame 30 serves as a detent for holding the lever 34A in a desired position of rotation.

Figure 6:
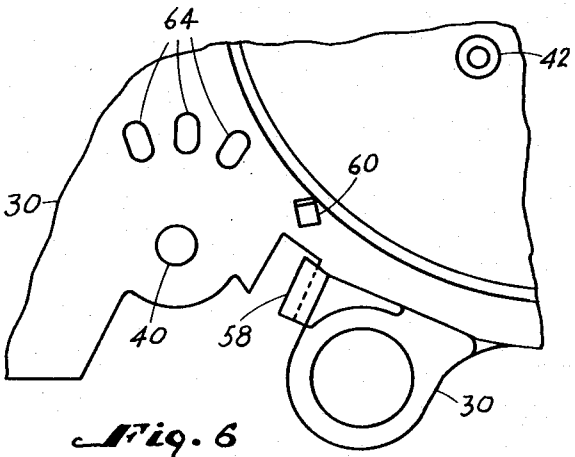
FIG. 6 is a further plan view of the encircled region of FIG. 1 wherein a tone lever of the volume control device is deleted to show a frame of the ringer.

In the view of FIG. 6, the tone control lever 34A has been deleted to show the portion of the frame 30 directly beneath the lever 34A and the gong 22 to show the ramp 60 and the gong support post 42. Also shown in FIG. 6 is the guide 58, the depresions 64 of the detent, and the shaft 40 for mounting the lever 34A. The arrangement of the foregoing components on the frame 30, as depicted in FIG. 6, demonstrates a feature of the invention in facilitating manufacture of the volume control device. In particular, it is noted that the ramp 60 and the guide 58 are readily formed from the material of the frame 30. These elements can be formed by cutting, stamping, and bending operations, all of which are readily accomplished by automatic machinery. Also, the shape of the lever 34A, as has been noted above, may be molded of plastic. Such molding is readily accomplished by automatic molding equipment. Accordingly, the invention has provided a volume control device, operative by damping the sonic vibrations of the gong, which is fabricated with a minimum number of parts. The device works efficiently and is econimical to produce.

It is to be undestood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A volume control device for a ringer having a gong, means for vibrating the gong to produce a sound, and a frame for supporting the gong and the vibrating means, said volume control device comprising:

means for damping vibrations of said gong, said damping means comprising a damping element and a pivot upstanding from said frame, said damping element being pivotable about said pivot and extending outward from said pivot a sufficient distance to contact said gong;

means for urging said damping element away from said frame to bring said damping element into contact with a rim of said gong to absorb vibrations thereof; said urging means upstanding in a fixed position from said frame and being spaced apart from said damping element prior to a rotation of said damping element about said pivot, rotation of said damping element about said pivot bringing said damping element into contact with said urging means, the amount of said urging being dependent upon rotation of said damping element about said pivot; and means fixedly positioned relative to said frame for guiding said damping element between a rim of said gong and said frame to said urging means during a rotation of said damping element about said pivot.

2. A volume control device according to claim 1 wherein said urging means urges an outer end of said damping element away from said frame to bring said damping element in contact with said rim of said gong, said rim contacting said damping element between said outer end and said pivot.

3. A volume control device according to claim 2 wherein said guiding means extends upwardly from said frame and further extends over a path of travel of said damping element for pressing said damping element towards said frame and away from said rim of said gong during a passage of said damping element by said guiding means.

4. A volume control device according to claim 3 wherein said guiding means is integrally formed with said frame.

5. A volume control device according to claim 1 wherein said urging means comprises a ramp facing said damping element, said damping element riding up on said ramp upon a pivoting of said damping element.

6. A volume control device according to claim 5 wherein said urging means is integrally formed with said frame.

7. A volume control device according to claim 1 wherein said urging means comprises a ramp facing said damping element, said damping element riding up on said ramp upon a pivoting of said damping element.

8. A volume control device according to claim 7 wherein said urging means is upstanding from said frame and integrally formed therewith.

9. A volume control device for a ringer having a gong, means for vibrating the gong to produce a sound, and a frame for supporting the gong and the vibrating means, said volume control device comprising:

a lever assembly;

a pivot upstanding from said frame, said lever assembly being rotatably mounted to said frame by said pivot;

said lever assembly comprising a wing extending outwardly from said pivot in a direction generally parallel to said frame;

a guide positioned on said frame for slidable engagement with said wing, said guide guiding said wing into a region between said gong and said frame upon rotation of said lever; and a ramp upstanding from said frame at a site underneath said gong, said ramp being located for engagement with said wing upon an exit of said wing from said guide, said ramp facing said wing for pushing said wing up against a lip of said gong for absorbing vibrations thereof.

10. A volume control device according to claim 9 wherein said ramp is located for receiving an outer end of said wing for urging said outer end upward towards an interior of said gong.

11. A volume control device according to claim 10 wherein said ramp is located beneath an interior region of said gong to provide for engagement of said wing with said lip of said gong for absorbing sonic vibrations thereof, an inner end of said wing being held at a fixed attitude by said pivot, said lip contacting said wing at a region thereof between said ramp and said pivot.

12. A volume control device according to claim 11 wherein said guide and said ramp are integrally formed with said frame.

13. A volume control device according to claim 9 wherein said lever assembly further comprises an arm and a leg extending in opposite directions from said pivot, said wing extending transversely of said leg, said arm and said leg and said wing being integrally formed as a unitary assembly, and wherein said pivot is mounted on said frame spaced apart from said gong.

14. A volume control device according to claim 13 wherein said frame further comprises a set of detents positioned for engagement with said leg upon rotation of said lever assembly about said pivot.

15. A volume control device according to claim 14 wherein said guide is positioned outside of said gong, and wherein said wing rests in contact with said guide during a setting of said control device producing maximum sound volume of said ringer.

* * * * *